US007514642B2

(12) United States Patent
Burca et al.

(10) Patent No.: US 7,514,642 B2
(45) Date of Patent: Apr. 7, 2009

(54) REMOTE FUNCTION ACTUATOR WITH PRESSURE EQUALIZER

(75) Inventors: John Burca, Rochester Hills, MI (US); Frank Goemmel, Sonnefeld (DE)

(73) Assignee: Lear Corporation GmbH, Ginsheim-Gustavsberg (DE)

( * ) Notice: Subject to any disclaimer, the term of this patent is extended or adjusted under 35 U.S.C. 154(b) by 284 days.

(21) Appl. No.: 11/306,033

(22) Filed: Dec. 14, 2005

(65) Prior Publication Data

US 2007/0131530 A1 Jun. 14, 2007

(51) Int. Cl.
*H01H 9/04* (2006.01)

(52) U.S. Cl. ..... 200/302.2; 200/293

(58) Field of Classification Search ..... 200/302.1, 200/302.2, 302.3, 515, 293–298
See application file for complete search history.

(56) References Cited

U.S. PATENT DOCUMENTS 5,768,925 A * 6/1998 Ozawa et al. ..... 70/408
5,885,254 A 3/1999 Matyas
5,916,671 A 6/1999 Dauber
6,460,386 B1 * 10/2002 Watanuki et al. ..... 70/456 R
6,462,291 B1 * 10/2002 Sachs ..... 200/302.2
6,510,988 B1 1/2003 Kraus
6,545,629 B1 * 4/2003 Johnson et al. ..... 200/9
6,691,539 B2 * 2/2004 Jacob et al. ..... 70/408
2004/0085251 A1 * 5/2004 Shimura ..... 343/872
2004/0099430 A1 * 5/2004 Scudder ..... 174/52.3
2007/0163354 A1 * 7/2007 Becher et al. ..... 73/715

* cited by examiner

*Primary Examiner*—Elvin G Enad
*Assistant Examiner*—Marina Fishman

(57) ABSTRACT

A remote function actuator with pressure equalization. A base or enclosure of the actuator (key fob) has one or more openings covered by a breathable waterproof membrane. The opening allows pressure equalization between the inside of the actuator and the outside environment, and the membrane material maintains the enclosure watertight for the electronic system positioned inside the actuator. Positioning the membrane in a recess and/or under a cover member helps protect the membrane from being damaged.

5 Claims, 2 Drawing Sheets

REMOTE FUNCTION ACTUATOR WITH PRESSURE EQUALIZER

TECHNICAL FIELD

The present invention relates to remote function actuators, such as key fobs for vehicles, and more particularly to remote function actuators with pressure equalizing systems.

BACKGROUND OF THE INVENTION

Remote function actuators are in wide spread use today. These actuators are commonly known as key fobs and are used to a large extent in the automotive industry. The remote function actuators are attached to ignition keys, door keys and the like and include a plurality of buttons to lock and unlock the car doors and also typically to open the trunk of the vehicle.

The remote function actuators are typically watertight radio-frequency (RF) electronic devices which transmit a signal when activated in order to actuate a mechanism such as the door lock, trunk lock, or the like. Some key fobs also are used to start the engine of a vehicle. Due to the environments in which key fobs are utilized, they must be operational in all ranges of temperatures, such as the extremes from 20-30° F. below zero to elevated temperatures of 100-150° F. or more. These temperature extremes, however, can create a significant build up of pressure inside the key fob which can over time loosen the tightness of the fob enclosure and compromises the water seals. The remote actuators must be waterproof since they are used in all kinds of inclement weather.

When the water seals are compromised or deteriorate, water or moisture can penetrate inside the key fob which can cause problems with the internal electronic system and device. In order to compensate for the effect of inflation or deflation due to pressures caused by the temperature extremes, some key fobs rely upon high clamping forces exerted over the water seals. However, this creates a difficulty for access to replace the batteries inside the actuators and often limits the water seal performance.

SUMMARY OF THE INVENTION

It is an object of the present invention to provide an improved remote function actuator. It is also an object of the present invention to provide a remote function actuator that maintains its water seal regardless of the temperature extremes to which the actuator is exposed.

It is a further object of the present invention to provide a remote function actuator that is capable of equalizing the pressures between the inside of its enclosure and the outside environment.

In accordance with the present invention, a remote function actuator (or key fob) is provided which meets the above objects and provides a unique and beneficial product. One or more holes or openings are provided in the enclosure and the holes are covered by a breathable waterproof membrane material. The opening and membrane allows pressure equalization between the inside of the enclosure and the outside environment over the entire temperature range typically experienced by remote actuators used for vehicles. In a preferred embodiment, the membrane is positioned in a recess and/or covered by a snap-on cover or housing for protection from being damaged.

The present invention eliminates or minimizes possible the deformation of the enclosures which can result from the significant build-up or drop in the internal pressure. The fabric material is both waterproof and breathable and can be, for example, Gore-Tex® fabric material.

These and other objects, features, benefits and details of the present invention can be found in the following description when viewed in accordance with the accompanying drawings and appended claims.

DESCRIPTION OF PREFERRED EMBODIMENTS

Figure 1:
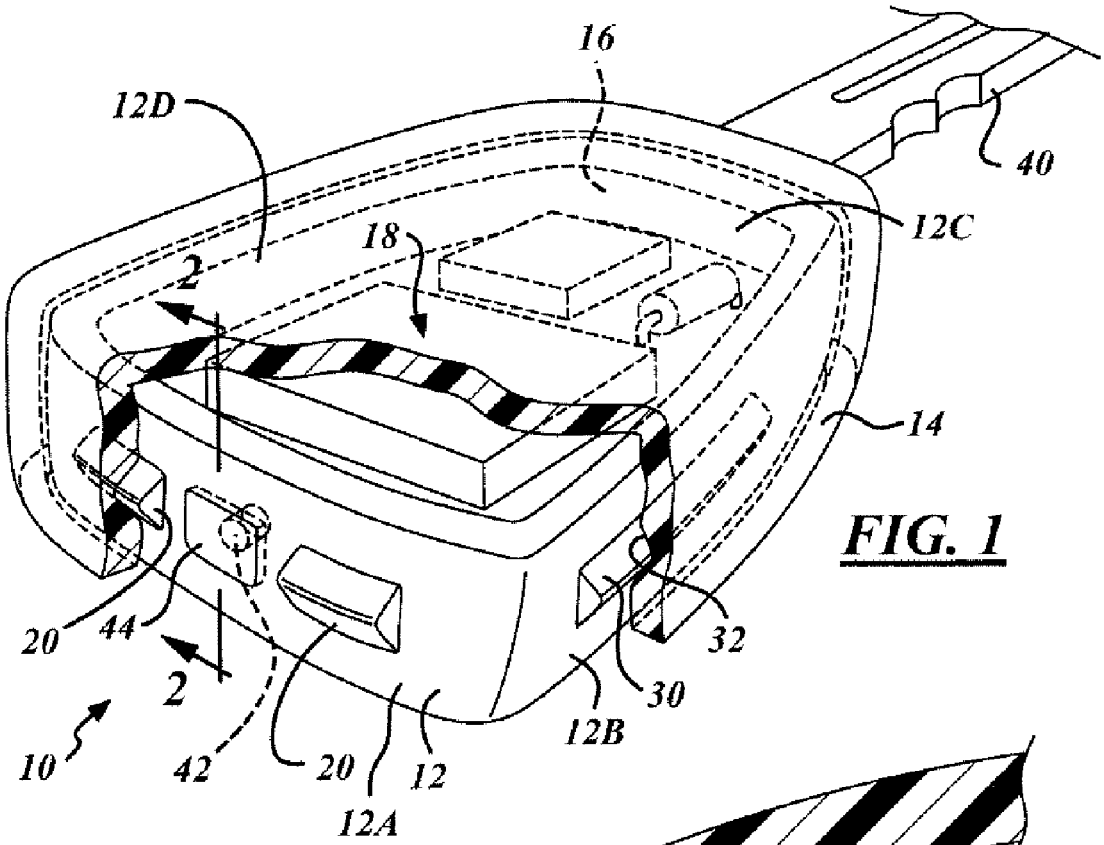
FIG. 1 is a schematic perspective view of a remote function actuator in accordance with a preferred embodiment of the present invention.
Figure 2:
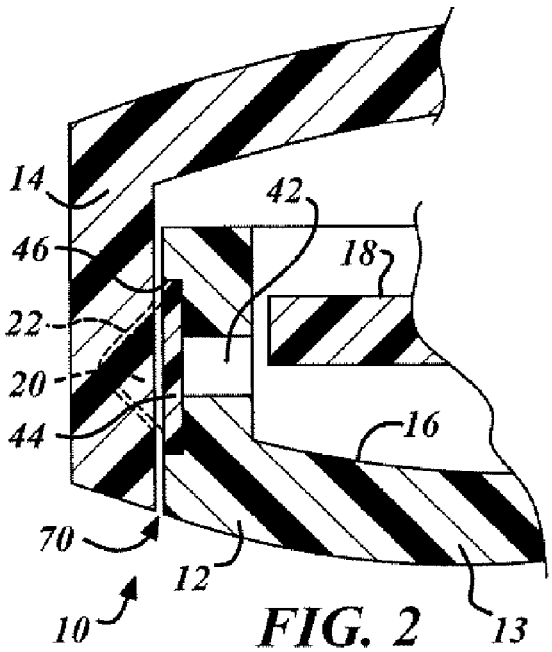
FIG. 2 is a cross-section of a portion of the actuator as shown in FIG. 1, when viewed in accordance with the line 2-2 in FIG. 1 and in the direction of the arrows.
Figure 3:
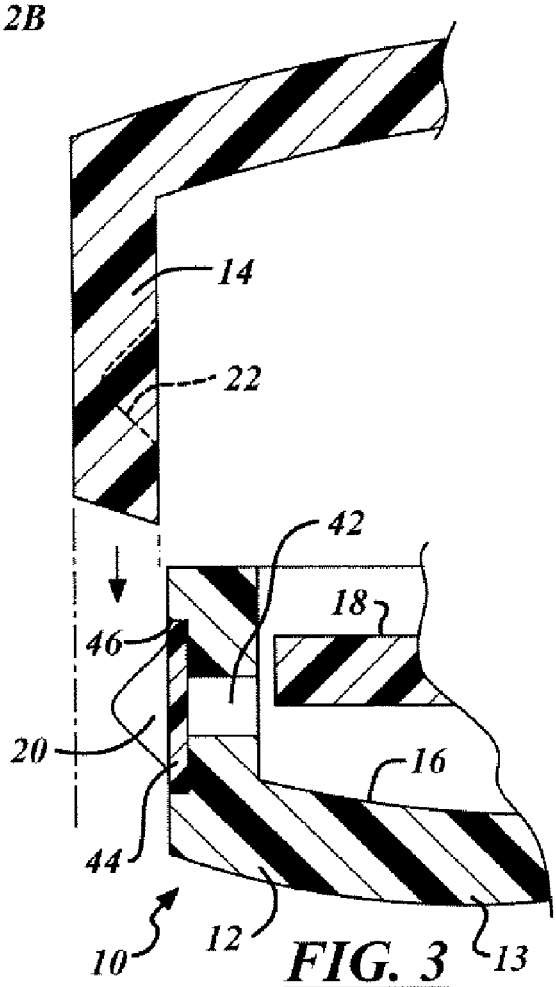
FIG. 3 is an exploded view of the portion of the actuator as shown in FIG. 2.

FIGS. 1-3 illustrate a preferred embodiment of the present invention. The remote function actuator, also commonly known as a "key fob," is referred to generally by the reference numeral 10. The present invention is particularly suitable for use with a remote function actuator which is used in the automotive industry for locking and unlocking the doors of the automobiles and also, typically, the trunk or hatchback. Some remote function actuators also are used to start the vehicle's engine and most contain a panic button.

As shown in FIGS. 1-3, the actuator 10 includes a base member or enclosure 12 and a cover member 14. The base member 12 has a plurality of side wall members 12A, 12B, 12C, and 12D, and a lower wall member 13. The base member/enclosure 12 also has an internal cavity 16 in which the electronic device or system 18 of the actuator is contained. The remote function actuators are typically radio-frequency (RF) electronic devices. Typically, a number of actuation buttons (not shown) are provided on the cover member 14 in order to activate the electronic device inside the actuator and have it activate the desired system. A key member 40 is shown in FIG. 1 attached to one end of the actuator 10.

Cover member 14 is designed to snap in place over the base member 12, as shown in FIGS. 2 and 3. For this purpose, the base member 12 includes a plurality of locking tabs 20, 30 which mate with corresponding locking recesses 22, 32 in the cover member 14. Although three mating tabs and recesses are illustrated, it is understood that any number can be provided or that other means can be utilized to secure the cover member 14 to the base member 12.

The base member 12 and cover member 14 can be made of any material, but preferably are made from a plastic material. Any of the plastic materials which are used for remote function actuators or key fobs today can be utilized.

An opening or hole 42 is provided in the base member enclosure 12 which allows air to enter or exit from the cavity 16. The opening 42 is covered by a membrane 44 of a breathable waterproof fabric material. The membrane member 44 is positioned in a corresponding recess 46 in the base member 12.

The opening or hole 42 can have any size which is suitable for the design. For example, the diameter of the opening 42 can be as small as 0.5 mm. The membrane 44 can be of any water resistant breathable material but preferably is made from a Gore-Tex® material. The Gore-Tex® fabric is available from the W. L. Gore and Associates Company in Newark, Del. Other waterproof, breathable membranes are available from RTC Textiles Co. in the United Kingdom and Dartex Coatings, Inc. in Slatersville, R.I.

Figure 4:
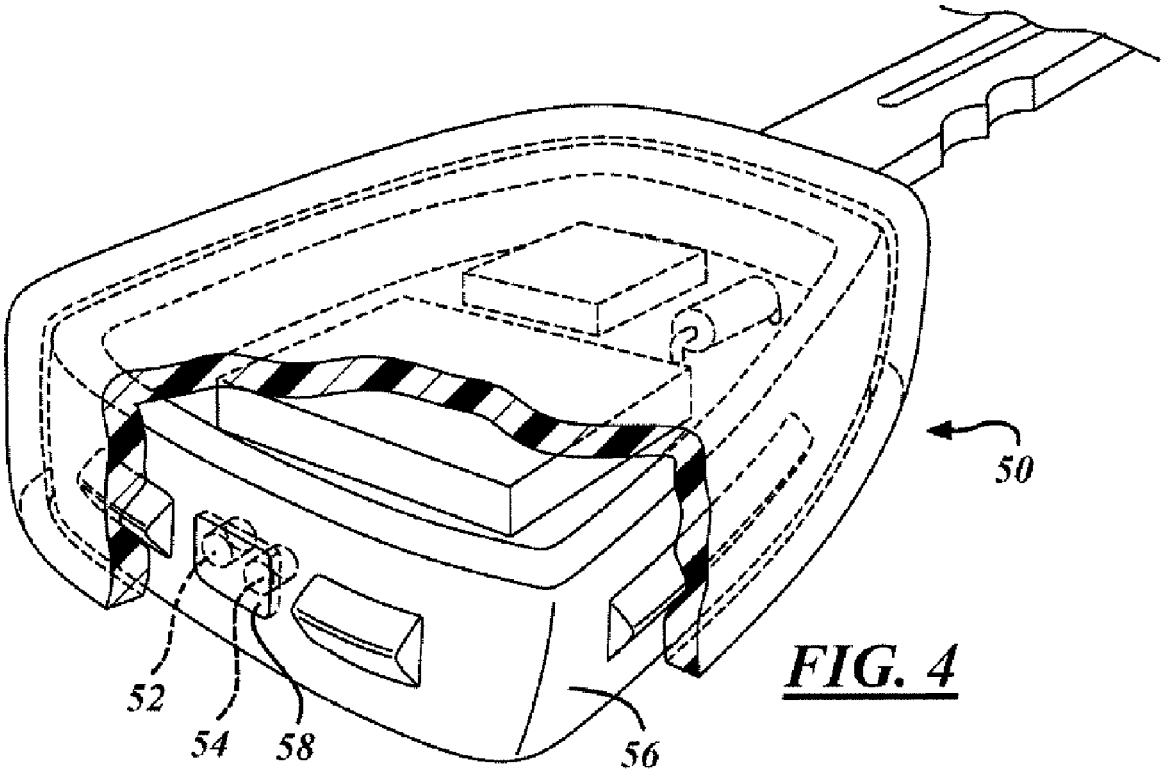
FIGS. 4 and 5 depict alternative embodiments of the invention.
Figure 5:
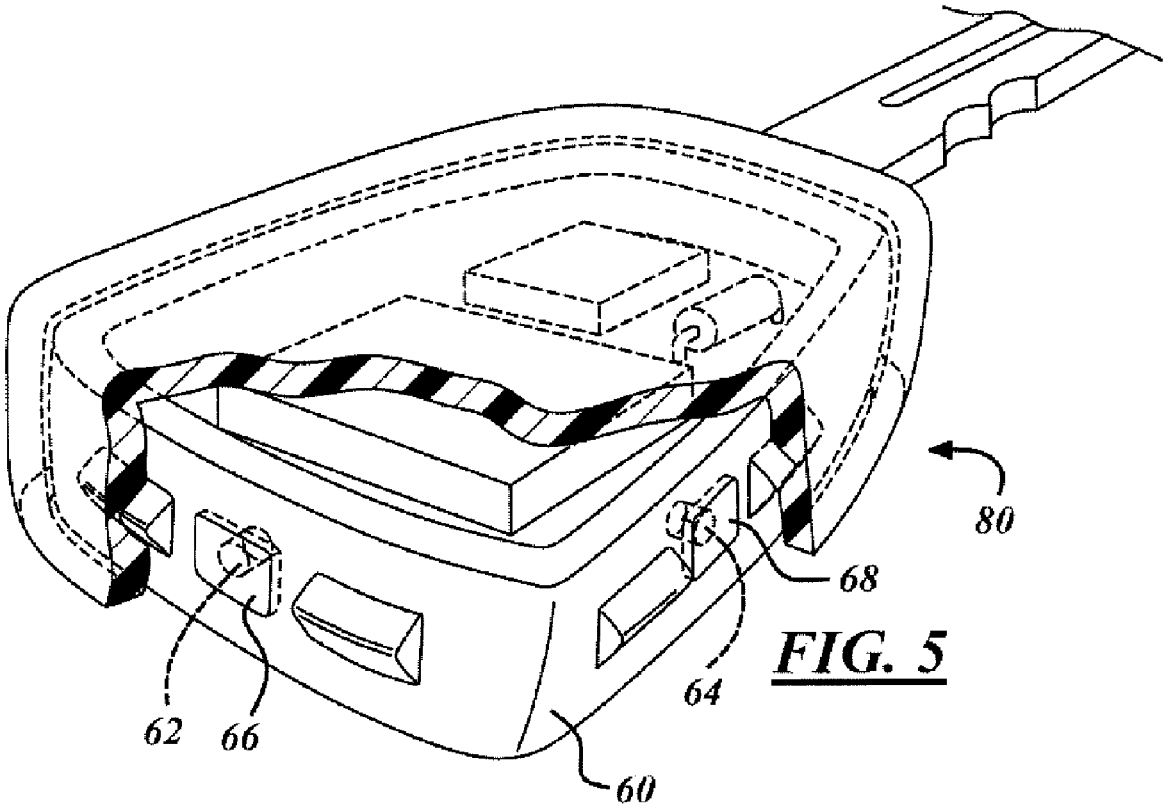

Although only one opening or hole 42 is shown in FIGS. 1-3, it is also possible to have two or more pressure equalization openings covered by waterproof breathable membranes in accordance with the present invention. For example, as shown in FIG. 4, two openings 52 and 54 are provided in enclosure 56. The two openings in this embodiment 50 are positioned sufficiently close together such that they are covered by the same membrane member 58. Also, as shown in FIG. 5, it is possible for the enclosure 60 in embodiment 80 to have two or more spaced apart pressure equalization holes or openings 62, 64 each separately covered by membrane members 66 and 68, respectively.

The membrane 44 in FIGS. 1-3 is preferably positioned in recess 46 for protection from being damaged. It is also possible, however, to simply have the membranes be applied to the surface of the base member or enclosure 12 (as shown in FIG. 5).

It is also preferable that the opening be provided in a position on the actuator base member such that the membrane is covered by the cover member 14. This provides additional protection for the membrane.

Also, as shown in FIG. 2, the cover member 14 is preferably positioned on the base member 12 leaving a slight air gap 70 between them which allows the pressure equalization to occur.

The membrane member 44 is fixedly secured to the base member 12. This can be done in any conventional manner, such as by insert molding, gluing, heat sealing, self-adhesive, or the like. Any conventional method and process can be used so long as the material is secured in a water-tight manner.

The opening 42 allows pressure equalization between the inside of the base member 12 and the outside environment. At the same time, the waterproof membrane maintains a complete water seal and prevents water from entering the cavity or compartment 16 within the base 12 and from adversely affecting the electronics. The present invention maintains a reliable waterproofing of the enclosure for the electronics over the entire temperature range of the liquid state of water, namely 0°-100° C. (−32° to 212° F.). The invention also eliminates any deformation in the plastic enclosure which might be caused from a significant buildup or drop in the internal pressure caused by the temperature fluctuations. For an RFA transmitter, the pressure variation occurs first in testing when a hot (85°-95° C.) RFA unit is dropped in 0° C. ice water.

The present invention also eliminates the pressure-induced deviations in the mechanical assembly. This means that a loose snap engagement of the mating halves from the inflation or deflation of the enclosure is prevented. As a result, the encasement will keep its water sealing performance closer to nominal over a wider temperature range.

While the invention has been described in connection with one or more embodiments, it is to be understood that the specific mechanisms and techniques which have been described are merely illustrative of the principles of the invention, numerous modifications may be made to the methods and apparatus described without departing from the spirit and scope of the invention as defined by the appended claims.

What is claimed is:

1. A remote function actuator comprising:

a base member containing a cavity having an electronic device positioned therein;

a cover member releasably secured to said base member and covering at least part of said electronic device;

said base member having a first wall member, said wall member having a recess therein and an opening in said recess; and a breathable water resistant member positioned in said recess and over said opening;

at least a portion of said cover member positioned over said recess and said breathable water resistant member;

thereby allowing pressure equalization between said cavity and the environment while preventing moisture from entering said cavity.

2. The remote function actuator as described in claim 1 wherein said base member has a box-like structure with a central cavity thereon.

3. The remote function actuator as described in claim 2 wherein said box-like structure has a plurality of wall members.

4. The remote function actuator as described in claim 1 wherein at least two openings are provided in said recess in said base member, said openings being individually or collectively covered by a breathable water resistant member.

5. The remote function actuator as described in claim 1 wherein said base member and cover member are releasably secured together by a snap-fitting mechanism.

* * * * *